US008740495B1

(12) United States Patent
Clark et al.

(10) Patent No.: US 8,740,495 B1
(45) Date of Patent: Jun. 3, 2014

(54) SHALLOW FLUSH-MOUNTED VEHICLE CONTROL BARRIER

(71) Applicant: SecureUSA, Inc., Cumming, GA (US)

(72) Inventors: Bevan M. Clark, Gainesville, GA (US); Mathew Sexton, Dawsonville, GA (US)

(73) Assignee: SecureUSA, Inc., Cumming, GA (US)

( * ) Notice: Subject to any disclaimer, the term of this patent is extended or adjusted under 35 U.S.C. 154(b) by 0 days.

(21) Appl. No.: 13/892,983

(22) Filed: May 13, 2013

Related U.S. Application Data

(63) Continuation of application No. 13/089,702, filed on Apr. 19, 2011, now Pat. No. 8,439,594.

(51) Int. Cl.
*E01F 13/00* (2006.01)
*E01F 15/00* (2006.01)
*E01F 13/08* (2006.01)

(52) U.S. Cl.
CPC ..... *E01F 13/08* (2013.01)
USPC ..... 404/6; 404/9; 404/10; 404/11; 256/13.1

(58) Field of Classification Search
CPC ..... E01F 13/12; E01F 15/12
USPC ..... 404/6, 9, 10; 256/1, 13.1
See application file for complete search history.

(56) References Cited

U.S. PATENT DOCUMENTS

| | | | | |
|---|---|---|---|---|
| 3,295,255 | A * | 1/1967 | Russo | 49/49 |
| 4,572,080 | A | 2/1986 | Williams et al. | |
| 4,624,600 | A | 11/1986 | Wagner et al. | |
| 4,627,763 | A | 12/1986 | Roemer et al. | |
| 4,705,426 | A | 11/1987 | Perea | |
| 4,775,261 | A | 10/1988 | Fladung | |
| 4,822,206 | A | 4/1989 | Roussel et al. | |
| 4,828,424 | A | 5/1989 | Crisp, Sr. | |
| 4,850,737 | A | 7/1989 | Nasatka et al. | |
| 4,861,185 | A | 8/1989 | Eikelenboon | |
| 5,228,237 | A | 7/1993 | Nasatka | |
| 5,639,178 | A | 6/1997 | Wilson et al. | |
| 5,704,730 | A | 1/1998 | Burton-Chambers | |
| 7,320,557 | B1 | 1/2008 | Potter | |
| 7,530,759 | B2 | 5/2009 | Gelfand et al. | |
| 7,866,912 | B2 | 1/2011 | Gelfand et al. | |
| 2004/0033106 | A1 | 2/2004 | Turpin et al. | |
| 2005/0214072 | A1 | 9/2005 | Turpin et al. | |
| 2005/0238424 | A1 | 10/2005 | Burns et al. | |
| 2006/0233609 | A1 | 10/2006 | Gelfand et al. | |
| 2007/0048083 | A1 | 3/2007 | Burns et al. | |
| 2008/0232902 | A1 | 9/2008 | Burns et al. | |
| 2009/0022546 | A1 | 1/2009 | Rastegar et al. | |
| 2011/0164920 | A1 | 7/2011 | Morgan et al. | |
| 2011/0164921 | A1 | 7/2011 | Morgan et al. | |
| 2012/0044046 | A1 | 2/2012 | Al-Jafar | |

OTHER PUBLICATIONS

U.S. Official Action dated Aug. 3, 2012 in U.S. Appl. No. 13/089,702.
U.S. Notice of Allowance/Allowability dated Jan. 8, 2013 in U.S. Appl. No. 13/089,702.

* cited by examiner

*Primary Examiner* — Raymond W Addie
(74) *Attorney, Agent, or Firm* — Hope Baldauff, LLC

(57) ABSTRACT

Systems and methods described herein provide for a flush-mounted vehicle control barrier having a shallow foundation. According to one aspect of the disclosure provided herein, a vehicle control barrier includes a sub-frame, a wedge plate, and an actuator mechanism that is coupled to the sub-frame and disposed within an interior space of the sub-frame.

17 Claims, 10 Drawing Sheets

SHALLOW FLUSH-MOUNTED VEHICLE CONTROL BARRIER

CROSS REFERENCE TO RELATED APPLICATIONS

This application is a continuation of prior U.S. patent application Ser. No. 13/089,702, entitled "SHALLOW FLUSH-MOUNTED VEHICLE CONTROL BARRIER" and filed on Apr. 19, 2011, now U.S. Pat. No. 8,439,594 issued Aug. 14, 2013, which is expressly incorporated herein by reference in its entirety.

BACKGROUND

Security is a primary concern for many facilities, particularly when positioned at potentially "hostile" locations where the potential for terroristic acts is increased. One potential threat includes vehicles containing explosives or other hazardous material approaching or impacting a fixed structure that is targeted for attack. There are various conventional methods for preventing vehicles from approaching structures, including the use of armed guards, gates, fencing, buttressed vehicle barriers, and/or bollards, to name a few.

Vehicle barriers are commonly placed at vehicle entry points that are located a safe distance from a building or structure being protected. These barriers may include deployable wedge plates that rise to prevent vehicles from passing over or through the barrier in order to prevent the vehicles from approaching the protected building until they have been deemed safe. Once a vehicle has been deemed safe, the wedge plate of the vehicle barrier may be lowered to allow the vehicle to safely drive over the wedge plate and through the barrier. Conventional vehicle barriers may include a buttress on one or both sides of the barrier. The buttress may include the actuator or other drive mechanism for deploying the wedge plate, as well as any associated circuitry, lights, gate arm mechanisms, and any other associated hardware. However, because the buttress is positioned immediately adjacent to the wedge plate over which vehicles are driving, the buttress is susceptible to damage from inadvertent contact with passing vehicles and lane widths are limited by the distance between buttresses. Many conventional barriers also have the wedge plate mounted on top of the road surface, which presents an obstacle for snowplows when driving over to clear the road. Moreover, the buttress may be aesthetically unappealing to building owners, particularly if multiple vehicle barriers are utilized near or around the building being protected.

In addition, conventional vehicle barriers utilize relatively deep underground compartments and corresponding foundations of poured concrete, typically 24 to 48 inches deep. This depth accommodates various hinges, drive mechanisms, and structural features that are typical in many vehicle barrier systems. However, in many metropolitan areas, it may be difficult to excavate to these depths due to underground structures, as well as various topographical and infrastructural features commonly associated with the installation locations around buildings and other facilities or structures.

It is with respect to these considerations and others that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

Systems and methods described herein provide for a vehicle control barrier that is substantially or entirely contained within a sub-frame that is mounted flush with the ground, eliminating the conventional buttress concept and allowing for a foundation that is significantly more shallow than that of a conventional vehicle control barrier. Utilizing the concepts described herein, authorized vehicles may be permitted to drive over a flush-mounted wedge plate, while unauthorized vehicles may be prevented from access over the vehicle barrier via deployment of a wedge plate that rotates upwards from ground level. Actuation devices and associated components may be mounted entirely within the sub-frame installed below ground level.

According to one aspect of the disclosure provided herein, a flush-mounted vehicle control barrier includes a sub-frame, a wedge plate, and an actuator mechanism. The sub-frame defines an interior space between top and bottom barrier surfaces. The wedge plate is coupled to the sub-frame and is coplanar with the top barrier surface when stowed. The actuator mechanism is coupled to the wedge plate and is disposed within the interior space when the wedge plate is in the stowed position. The actuator mechanism operates to rotate the wedge plate between the stowed position and a deployed position.

According to another aspect, a method for providing a vehicle control barrier is provided. The method includes connecting a rear edge of a wedge plate to a sub-frame so that the wedge plate pivots around the rear edge when raising and lowering. An actuator mechanism is mounted within an interior space of the sub-frame and is coupled to a bottom side of the wedge plate. When activated, the actuator mechanism applies a deploying force to the wedge plate from the bottom side and rotates the wedge plate upwards from the sub-frame. When reversed, the actuator mechanism allows the wedge plate to rotate to a stowed position that is coplanar with a top surface of the sub-frame.

According to yet another aspect, a vehicle control barrier system includes a sub-frame having a top surface, a bottom surface, and an interior space between the two surfaces. The sub-frame includes a number of modular sections coupled together to create a barrier with a desired length. A wedge plate is coupled to the sub-frame. The wedge plate is coplanar with the top surface of the sub-frame when stowed and is sized according to the desired length of the barrier. An actuator mechanism is coupled to the wedge plate and is installed within the interior space of the sub-frame. A controller is coupled to the actuator mechanism and is operative to activate the actuator mechanism in forward and reverse directions in order to rotate the wedge plate between the stowed and deployed positions.

The features, functions, and advantages that have been discussed can be achieved independently in various embodiments of the present disclosure or may be combined in yet other embodiments, further details of which can be seen with reference to the following description and drawings.

BRIEF DESCRIPTION OF THE DRAWINGS

The present invention is illustrated by way of example and not limitation in the figures of the accompanying drawings, in which like references indicate similar elements and in which.

DETAILED DESCRIPTION

The following detailed description is directed to systems and methods for providing a flush-mounted vehicle control barrier. As discussed briefly above, typical barriers may utilize deep foundations and include one or more buttresses that contain the actuating mechanisms and other operating and/or control components that are subjected to damage from vehicle impact. However, utilizing the concepts and technologies described herein, a flush-mounted vehicle control barrier is configured with the control components located within a sub-frame that is installed within a shallow foundation below ground level. By including the control components within a foundation that is more shallow than conventional barrier system foundations according to the various embodiments disclosed below, a flush-mounted vehicle control barrier is provided that is easy to install and that is fully functional to prevent vehicle access while minimizing the above-ground prominence of the system.

Figure 1:
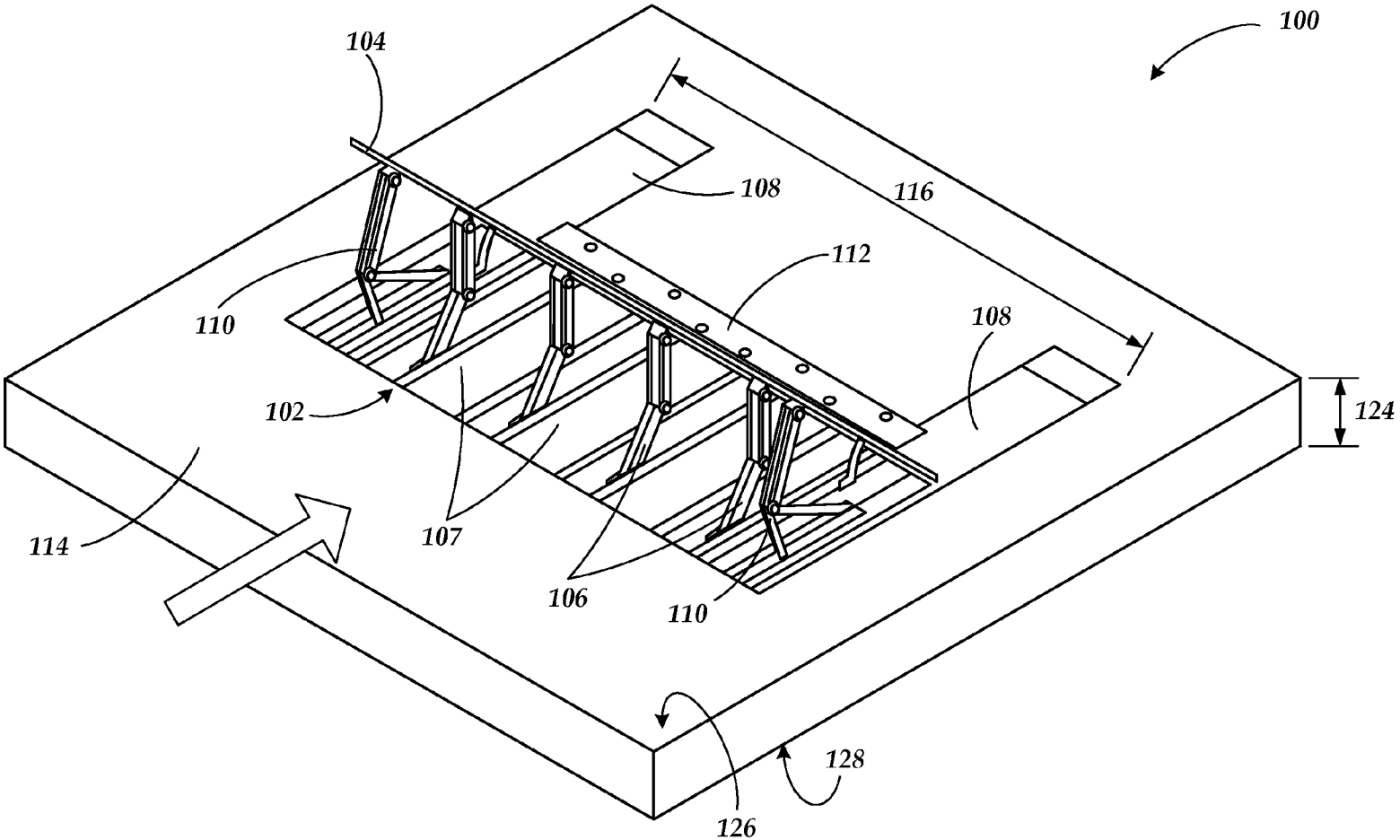
FIG. 1 is a perspective view of an installed flush-mounted vehicle control barrier system in a deployed configuration with a wedge plate raised according to embodiments presented herein.

In the following detailed description, references are made to the accompanying drawings that form a part hereof, and which are shown by way of illustration, specific embodiments, or examples. Referring now to the drawings, in which like numerals represent like elements through the several figures, a flush-mounted vehicle control barrier system and method will be described. FIG. 1 shows an illustrative view of a vehicle control barrier system 100 in a deployed configuration. The vehicle control barrier system 100 is designed to raise a wedge plate 104 to a deployed position to prevent passage of a vehicle over the vehicle control barrier system 100 in a direction indicated by the open arrow. To allow a vehicle to pass, the wedge plate 104 is lowered to a stowed position, which will be described below with respect to FIG. 2. The various components of the vehicle control barrier system 100 will be described generally with respect to FIGS. 1 and 2 before being described in greater detail with respect to FIGS. 3-10.

Looking at FIG. 1, the vehicle control barrier system 100 includes a sub-frame 102 that is configured for anchoring into a road or the ground. The sub-frame 102 contains structural support members to which the various barrier system components are attached. These structural support members additionally function to disperse the crash energy from a vehicle collision throughout the foundation 114 of the vehicle control barrier system 100. According to various embodiments, the structural support members of the sub-frame 102 may include any number of C-channels 107 or I-beams, in addition to the drive box assemblies 108 on opposing ends of the sub-frame 102 that house the control components of the vehicle control barrier system 100.

The sub-frame 102 may be modular, having any number of separate modules secured together to create the sub-frame 102 of desired width 116. For example, the vehicle control barrier system 100 may be provided with a wedge plate 104 in 12-foot and 14-foot widths, or any other suitable width according to the particular implementation. A sub-frame 102 that utilizes a 12-foot wedge plate 104 may be easily modified for use with a 14-foot wedge plate 104 by disconnecting the drive box assemblies 108 from the ends of the sub-frame 102 and bolting expansion modules to the end and re-coupling the drive box assemblies. In this manner, the sub-frame 102 may be created from an appropriate number of like sub-frame modules bolted or otherwise secured together, with drive box assemblies 108 connected on opposing ends of the sub-frame 102. Alternatively, there may be more than one size and/or type of module that may be used in any suitable combination to provide a vehicle control barrier system 100 with a sub-frame 102 of desired width 116. The modules will be shown and described further below with respect to FIG. 5.

The top surfaces of the sub-frame components define a top barrier surface 126 that will be coplanar, or flush, with the surface of the road or ground in which the sub-frame 102 is installed. The bottom surfaces of the sub-frame components define a bottom barrier surface 128 that is opposite and parallel to the top barrier surface 126. One or more compartments within the interior space between the top barrier surface 126 and the bottom barrier surface 128 provide the shallow stowage space for the impact-absorption linkages 106 when folded in the stowed configuration. The sub-frame 102 may additionally be connected to any type and quantity of rebar and/or other structural reinforcement materials. During installation, these materials are encompassed by concrete or other material to create a foundation 114 that anchors the vehicle control barrier system 100 to the ground with sufficient strength to withstand a designed impact force from a collision with a vehicle, yet is more shallow than conventional barrier systems.

The wedge plate 104 of the vehicle control barrier system 100 is rotatably coupled to the sub-frame 102 via a hinge mechanism 112 along a rear edge of the wedge plate 104. The hinge mechanism 112 additionally includes a locking mechanism that secures the rear edge of the wedge plate 104 in place in the event of a vehicle impact. This locking mechanism will be described in detail below with respect to FIGS. 4B and 4C. Although a single hinge mechanism 112 is shown in the figures, any number and type of suitable hinge mechanisms 112 may be utilized within the scope of this disclosure. While conventional barrier systems may utilize pipe-type hinges that extend below the top barrier surface 126, these conventional systems utilize a deeper foundation due to the positioning and size of these hinges and other components. In contrast, according to various embodiments disclosed herein the hinge mechanism 112 is mounted flush, or coplanar, with the top barrier surface 126 and does not extend into the interior space between the top barrier surface 126 and the bottom barrier surface 128. In doing so, this hinge mechanism 112 allows the vehicle control barrier system 100 to have a shallow depth 124 as compared to conventional barrier systems. According to various embodiments, the depth 124 may be approximately 15 inches, which is a substantial improvement over the typical 24-48 inch foundation depths of conventional barrier systems. As will be discussed in greater detail below, the control components of the vehicle control barrier system 100 and the configuration of these components within the sub-frame 102 additionally contribute to the shallow depth 124 of the system.

The wedge plate 104 may be manufactured from any suitable material and may be any thickness. The precise material characteristics may depend on the designed capability to withstand a particular maximum impact force in light of the various components and configuration of the vehicle control barrier system 100. As discussed above, the wedge plate 104 may be any suitable dimensions and may be provided in standard widths to accommodate typical access entryway and roadway widths, such as 12-foot, 14-foot, and 16-foot widths. To further enhance the capability of the vehicle control barrier system 100 to prevent vehicles from traversing the barrier, the vehicle control barrier system 100 may include a number of impact-absorption linkages 106 that are coupled to the bottom side of the wedge plate 104 and to the sub-frame 102. According to various embodiments, the impact-absorption linkages 106 are two-piece articulated linkages or devices that are centrally jointed to fold inward during stowage of the wedge plate 104 and to unfold and/or extend outward as the wedge plate 104 is deployed. As a vehicle impacts the vehicle control barrier system 100, the impact-absorption linkages 106 absorb a substantial portion of the impact force from the wedge plate 104. It should be appreciated that any number and type of impact-absorption linkages 106 may be utilized in the vehicle control barrier system 100 without departing from the scope of this disclosure. Additional aspects of the impact-absorption linkages 106 will be described in greater detail below with respect to FIGS. 3 and 4.

To raise and lower the wedge plate 104 the control components within the drive box assemblies 108 are coupled to the bottom side of the wedge plate 104 via control linkages 110. As will become clear below during the discussion of the control components with respect to FIGS. 9 and 10, the control linkages 110 allow the actuator mechanisms used to drive the wedge plate 104 to be mounted horizontally within the drive box assemblies 108 in the interior space between the top barrier surface 126 and the bottom barrier surface 128. In doing so, the depth 124 of the vehicle control barrier system 100 is minimized.

According to various embodiments, the sub-frame 102 is U-shaped, with the drive box assemblies 108 extending rearward from opposing ends of the wedge plate 104. It should be appreciated that other shapes and configurations are possible without departing from the scope of this disclosure. For example, if only a single actuator were used to drive the wedge plate 104 between deployed and stowed configurations, then only a single drive box assembly 108 may be used. Moreover, it is contemplated that the control components used within the vehicle control barrier system 100 may be configured such that the drive box assemblies 108 extend forward from the sub-frame 102 rather than rearward, or do not extend from the sub-frame 102 in either direction.

As mentioned above, the sub-frame 102 may be coupled to, or may include, a grid or framework of rebar and/or other concrete reinforcing material into which concrete is poured to create the foundation 114 for the vehicle control barrier system 100. The force from a vehicle impact would be distributed from the impact-absorption linkages 106 and wedge plate 104, through the sub-frame 102, and into the concrete of the foundation 114. The foundation 114 may be any suitable shape and size according to the designed impact absorption characteristics of the corresponding vehicle control barrier system 100.

It should be understood that the vehicle control barrier system 100 may be configured according to any desired dimensions. The size and shape of the foundation 114 may depend upon the corresponding size and shape of the sub-frame 102, the desired performance criteria of the vehicle control barrier system 100, the soil characteristics into which the foundation 114 will be installed, the characteristics of the concrete or other material used within the foundation 114, as well as any other applicable characteristics, and is not limited to the aspects of the foundation 114 shown in the various figures. According to one illustrative example, the depth 124 of the foundation 114 of this example may be approximately one foot, three inches. Continuing this example, the wedge plate 104 may be sized such that the vertical distance from the front edge of the wedge plate 104 to the top barrier surface 126 is approximately three feet when the wedge plate 104 is in the deployed configuration as shown in FIG. 1.

Figure 2:
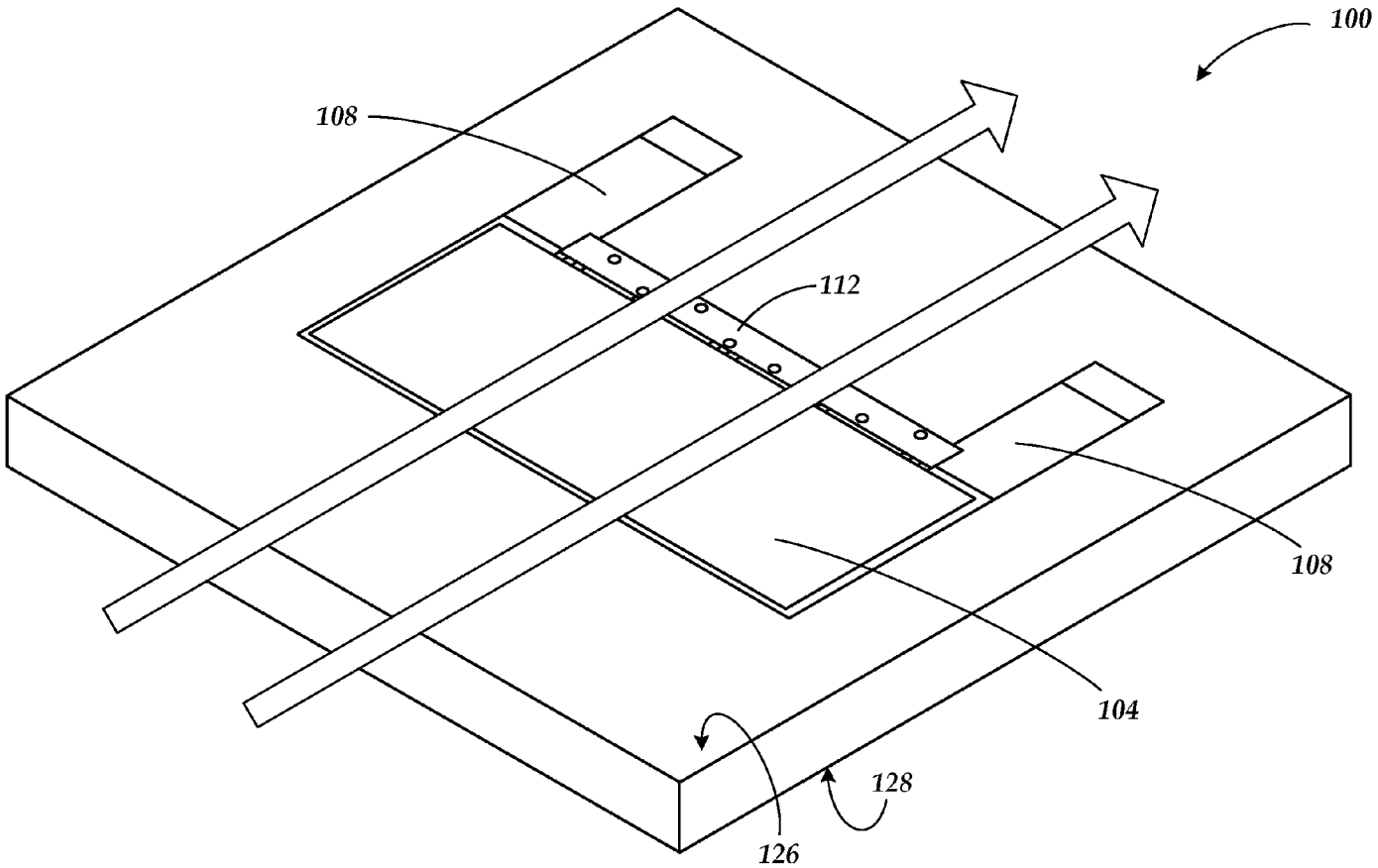
FIG. 2 is a perspective view of the flush-mounted vehicle control barrier system of FIG. 1 in a stowed configuration with the wedge plate lowered according to embodiments presented herein.

Turning to FIG. 2, the vehicle control barrier system 100 is shown in the stowed configuration with the wedge plate 104 lowered to allow vehicles to traverse the barrier in the direction indicated by the open arrows. As seen in the illustration, the wedge plate 104, the hinge mechanism 112 and the drive box assemblies 108 are all flush with the top barrier surface 126. Because the vehicle control barrier system 100 is installed with the top barrier surface 126 flush with the adjacent roadway or ground, the vehicle is able to smoothly and safely traverse the vehicle control barrier system 100. According to various embodiments, an anti-skid coating may be provided on all or any of the exposed top surfaces of the vehicle control barrier system 100 to further enhance safety in all weather conditions.

Figure 3:
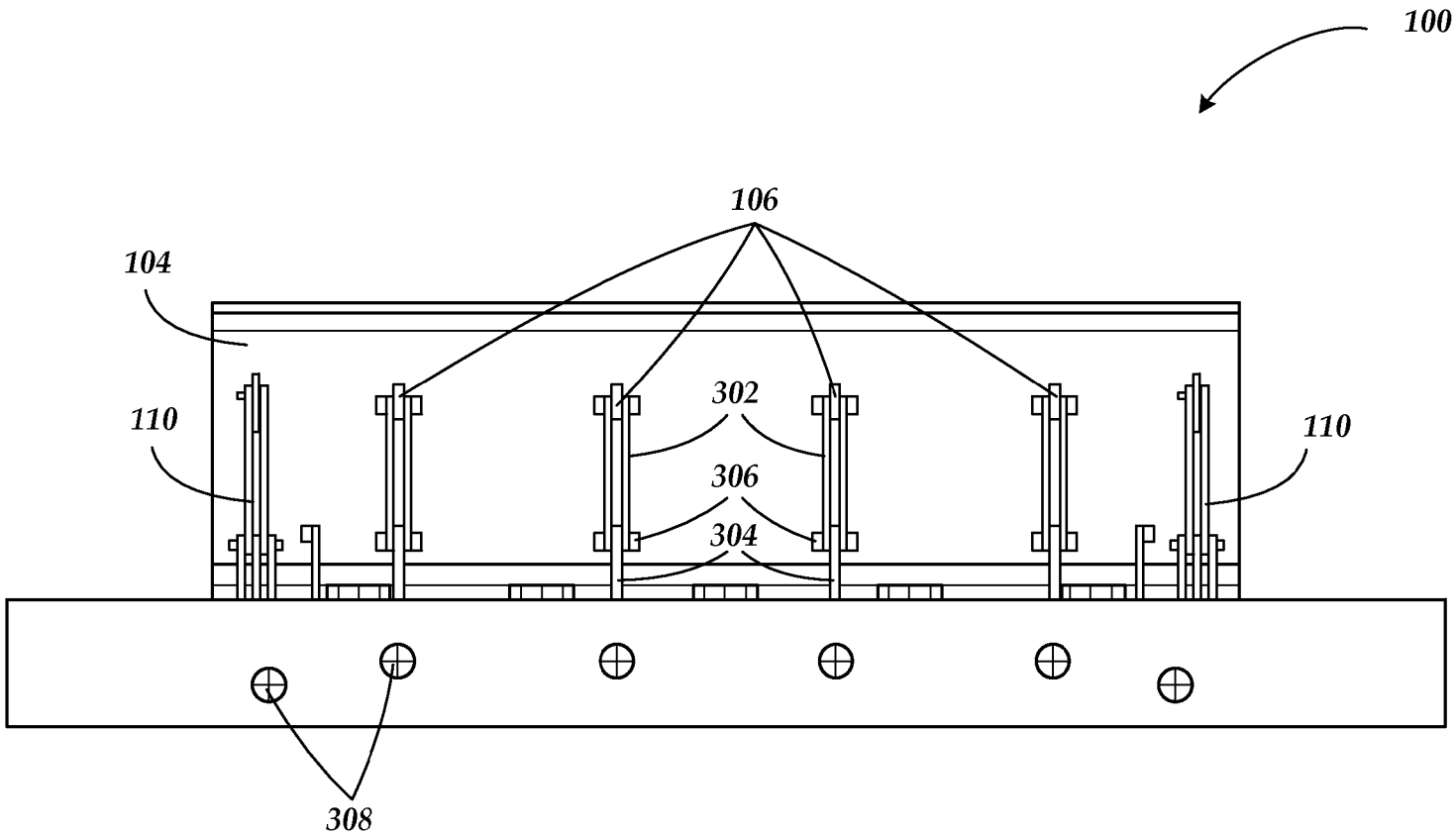
FIG. 3 is front view of the flush-mounted vehicle control barrier system of FIG. 1 in the deployed configuration according to embodiments presented herein.
Figures 4A, 4B, 4C:
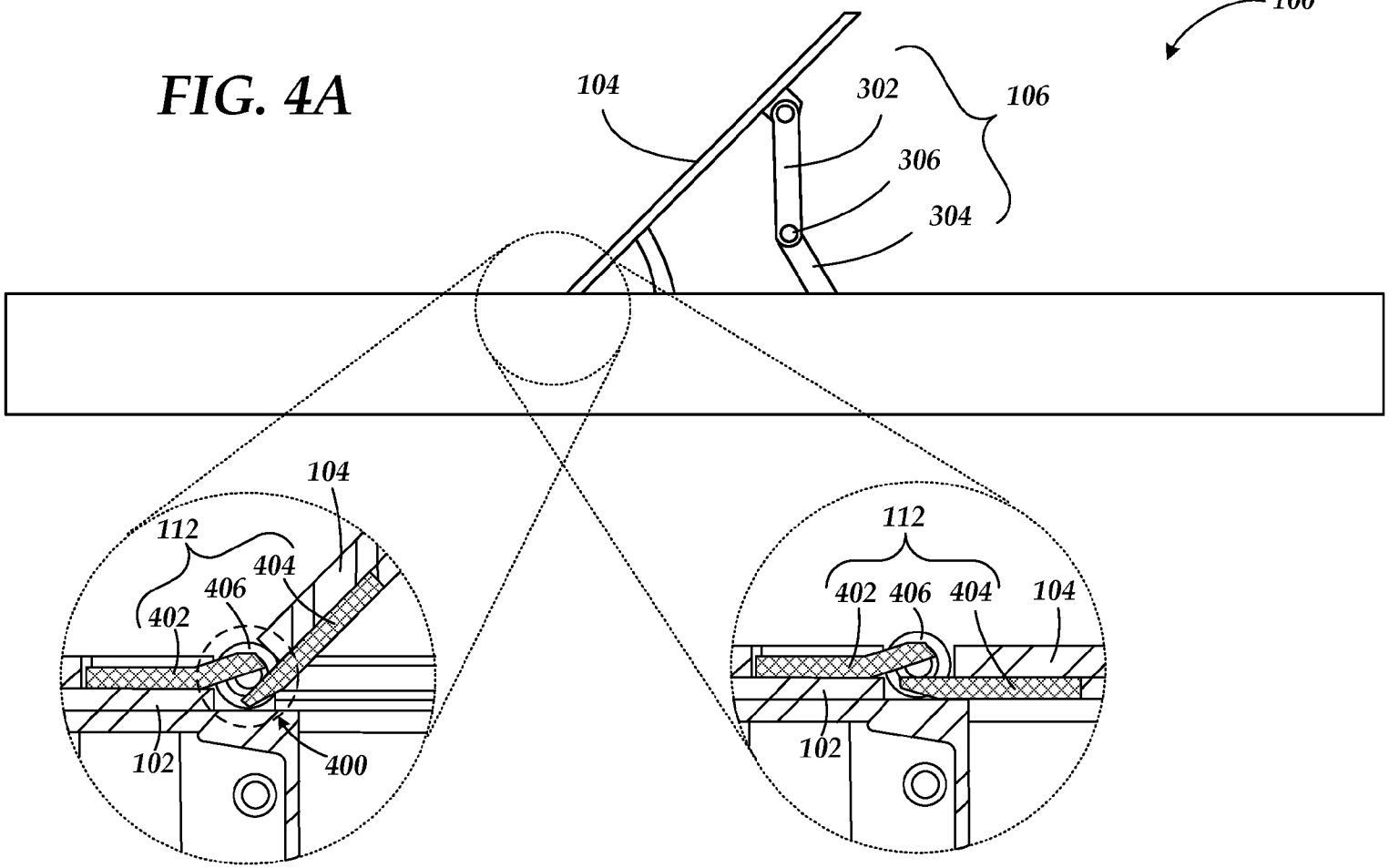
FIG. 4A is a side view of the flush-mounted vehicle control barrier system of FIG. 1 in the deployed configuration according to embodiments presented herein.
FIG. 4B is an enlarged view of an internal portion of the flush-mounted vehicle control barrier system of FIG. 4A showing components of the hinge mechanism in the deployed configuration according to embodiments presented herein.
FIG. 4C is an enlarged view of an internal portion of the flush-mounted vehicle control barrier system of FIG. 4A showing components of the hinge mechanism in the stowed configuration according to embodiments presented herein.

FIGS. 3 and 4A show front and side views, respectively, of the vehicle control barrier system 100 of FIGS. 1 and 2 in the deployed configuration. The impact-absorption linkages 106 that are attached to the wedge plate 104 and the sub-frame 102 can be clearly seen in these two views. The control linkages 110 that couple the actuator mechanisms (not shown) to the wedge plate 104 have been omitted from the side view of FIG. 4A to better illustrate the configuration of the impact-absorption linkages 106 according to one embodiment. As discussed above, the impact-absorption linkages 106 may each be a two-piece articulated linkage that is centrally jointed to fold inward during stowage of the wedge plate 104 and to unfold and/or extend outward as the wedge plate 104 is deployed.

As seen in FIGS. 3 and 4A, according to one implementation, each impact-absorption linkage 106 includes an upper linkage member 302, a lower linkage member 304, and a central joint 306 around which the upper and lower linkage members 302 and 304 rotate. Each upper linkage member 302 may be a two-piece component that includes a central space that is sized to provide a stowage space for the corresponding lower linkage member 304 when the impact-absorption linkage 106 is folded in the stowed configuration.

It should be appreciated that alternative embodiments may incorporate impact-absorption linkages 106 with varying configurations than those shown and described herein. For example, the impact-absorption linkages 106 may be configured with any number of linkage members rather than having an upper linkage member 302 and a lower linkage member 304. Irrespective of the number of linkage members, each linkage member may have any number of components rather than having a two-piece upper linkage member 302 and a one-piece lower linkage member 304. The impact-absorption linkages 106 may be configured to fold outward with the central joint 306 translating forward when stowing the wedge plate 104 rather than folding inward such that the central joint 306 translates rearward with the lowering of the wedge plate 104 as shown. The impact-absorption linkages 106 may be manufactured from high-carbon steel or any other sufficient material, and according to any suitable dimensions and in any quantity, in order to provide the designed impact resistance performance characteristics.

FIG. 3 additionally shows a number of foundation drains 308. The foundation drains 308 provide a fluid pathway from each compartment within the sub-frame 102 through the foundation 114 to the surrounding earth or external drains in order to prevent water from accumulating within the vehicle control barrier system 100. It should be understood that each compartment within the sub-frame 102 may include a drain on the front side as seen in the figures, as well as a drain on the rear side of the vehicle control barrier system 100. Depending on the installation location, the uphill drain, if any, could be closed off and the downhill drain utilized to evacuate water from the vehicle control barrier system 100.

FIGS. 4B and 4C show enlarged views of the hinge mechanism 112 with the wedge plate 104 in deployed and stowed configurations, respectively. As discussed above, according to one embodiment, the hinge mechanism 112 includes a locking mechanism 400. The locking mechanism 400 is configured to prevent rearward lateral movement of the wedge plate 104 when positioned in the deployed configuration. For example, if a vehicle were to impact the wedge plate 104 when the wedge plate 104 is raised in the deployed configuration, then the locking mechanism 400 provides an additional measure for preventing the rear edge of the wedge plate 104 from breaking free from the vehicle control barrier system 100 and moving rearward with the momentum of the vehicle.

According to one embodiment, the hinge mechanism 112 includes an anchor plate tab 402 and a wedge plate tab 404, pivotably coupled via a pivot component 406. The anchor plate tab 402 may be welded or otherwise rigidly fixed to the sub-frame 102. The wedge plate tab 404 may be welded or otherwise rigidly fixed to the rear edge of the wedge plate 104. The wedge plate 104 and wedge plate tab 404 rotate around the pivot component 406 during deployment and retraction of the wedge plate 104. The locking mechanism 400 includes the configuration of the wedge plate tab 404 with respect to the anchor plate tab 402. Specifically, the rear edge of the wedge plate tab 404 is positioned below a front edge of the anchor plate tab 402. In doing so, even in the event of a failure of the pivot component 406, any rearward lateral movement of the wedge plate tab 404 and corresponding wedge plate 104 would be limited or prevented by the anchor plate tab 402, which is secured to the sub-frame 102.

Figure 5:
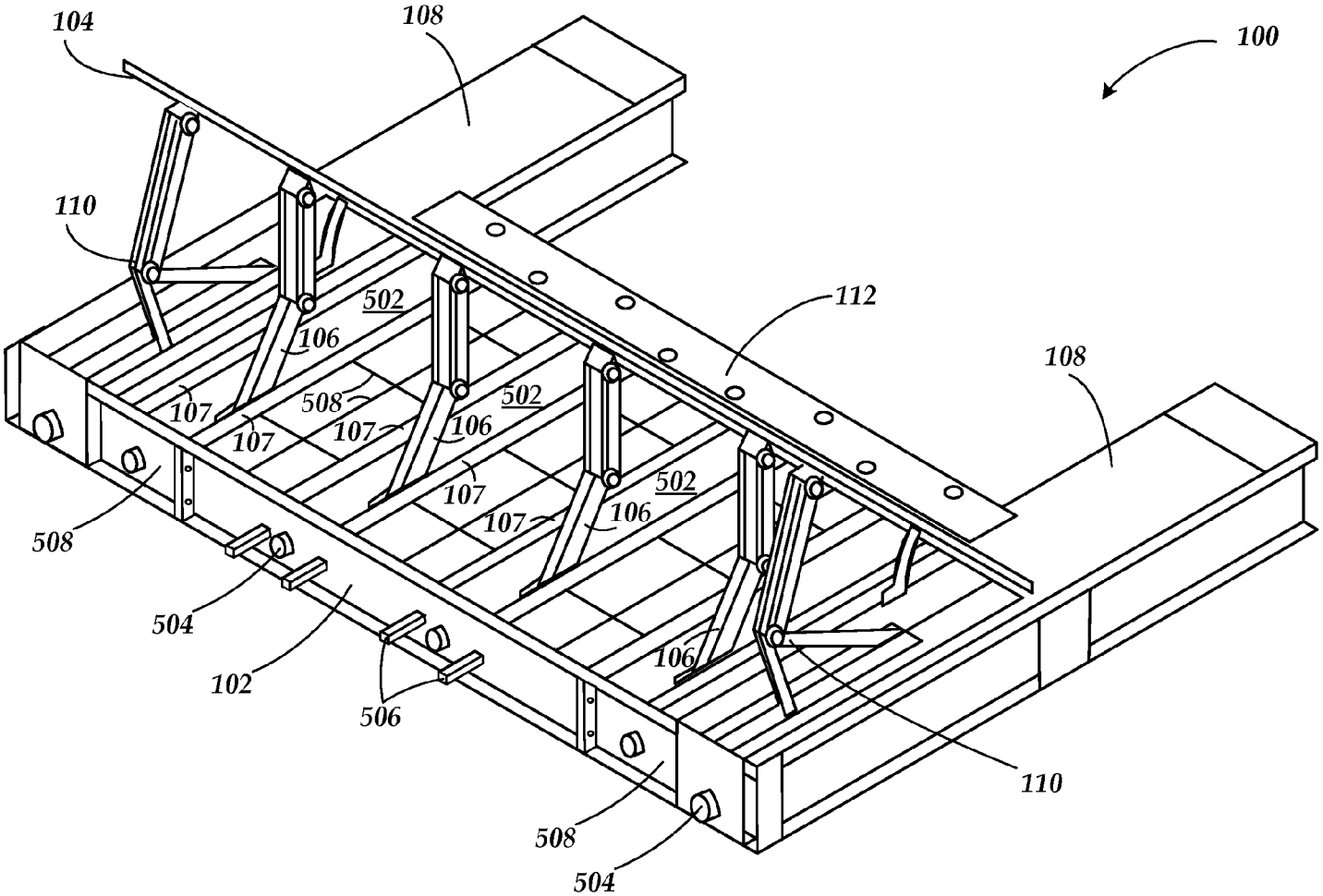
FIG. 5 is a perspective view of an uninstalled flush-mounted vehicle control barrier system in a deployed configuration with a wedge plate raised according to embodiments presented herein.

Turning now to FIG. 5, a perspective view of the vehicle control barrier system 100 without the foundation 114 is shown. With this view, the wedge plate 104 can be seen connected to the sub-frame 102 via the hinge mechanism 112, impact-absorption linkages 106, and control linkages 110. As discussed above and shown in FIG. 5, the sub-frame 102 may include various compartments 502 that accommodate different components of the vehicle control barrier system 100. In this example, the compartments 502 receive the folded impact-absorption linkages 106 when in the stowed configuration. There may also be additional compartments 502 that are not used for stowing barrier components. An example includes compartments within expansion modules that are secured in-line between one or more modules of the sub-frame 102 and drive box assemblies 108 when expanding the width 116 of the sub-frame 102 for use with a wider wedge plate 104. Compartment drains 504 in the front and rear of the compartments 502 may be connected to the foundation drains 308 described above to provide a fluid pathway from each compartment 502 within the sub-frame 102 through the foundation 114 to the surrounding earth or external drains in order to prevent water from accumulating within the vehicle control barrier system 100.

According to one embodiment, the sub-frame 102 may include reinforcements 508 interspersed between the C-channels 107. The reinforcements may include rebar or other structural members. These areas within the sub-frame 102 may additionally receive concrete for further anchoring and crash force dissipation. The exterior vertical surfaces of the sub-frame 102 may include force distribution pins 506 that protrude from sub-frame 102 and provide attachment mechanisms for rebar and additional surface area for adherence to the concrete of the foundation 114. When a vehicle impacts the wedge plate 104, the forces from the impact are distributed through the wedge plate 104 and impact-absorption linkages 106 to the sub-frame 102 and into the concrete of the foundation 114 and associated rebar through the force distribution pins 506. Although the force distribution pins 506 are only shown to be protruding from the front surface of the sub-frame 102, it should be appreciated that any number of force distribution pins 506 may be positioned at any location around any and all sides of the sub-frame 102.

Figure 6A:
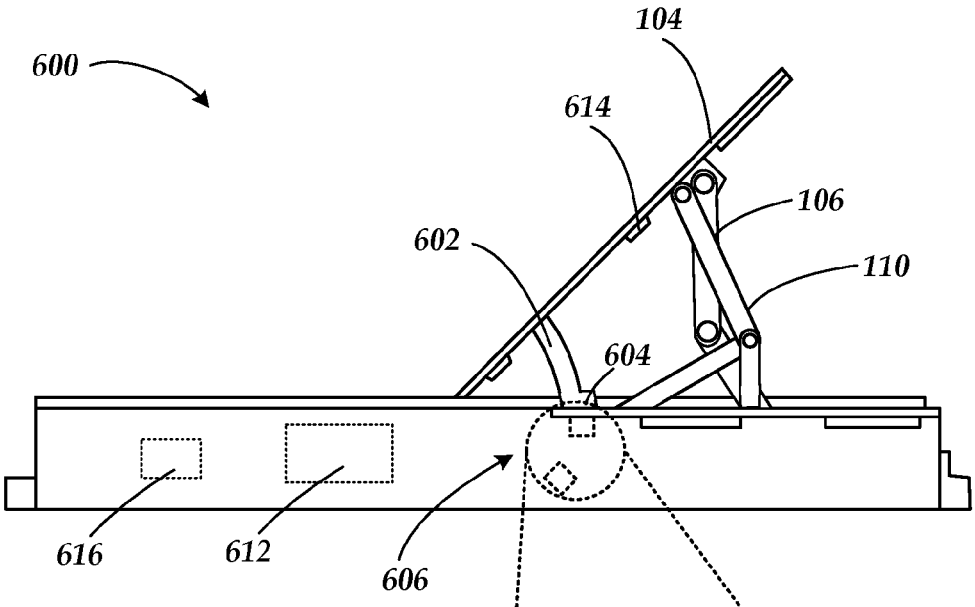
FIG. 6A is a side view of the uninstalled flush-mounted vehicle control barrier system of FIG. 5 in the deployed configuration according to embodiments presented herein.

FIG. 6A shows a side view of an uninstalled vehicle control barrier system 100 with a wedge plate position detection system 600. As discussed above, the vehicle control barrier system 100 may include a wedge plate position detection system 600 that is operative to detect the current position of the wedge plate 104. Based on the current position of the wedge plate 104, the controller 612 may be programmed to slow or stop the wedge plate 104. It should be understood that any number and type of position detection system components may be utilized to provide the proximity data to the controller 612. Although three example wedge plate position detection systems 600 will be described herein for illustrative purposes, the current disclosure is not limited to use of these systems. Additionally, although the three example wedge plate position detection systems 600 are shown together in FIGS. 6A and 6B for clarity purposes, any single wedge plate position detection system 600 shown and described may be utilized to detect the current position of the wedge plate 104, as well as any other system not described herein that is functional to determine the position of the wedge plate 104.

Figure 6B:
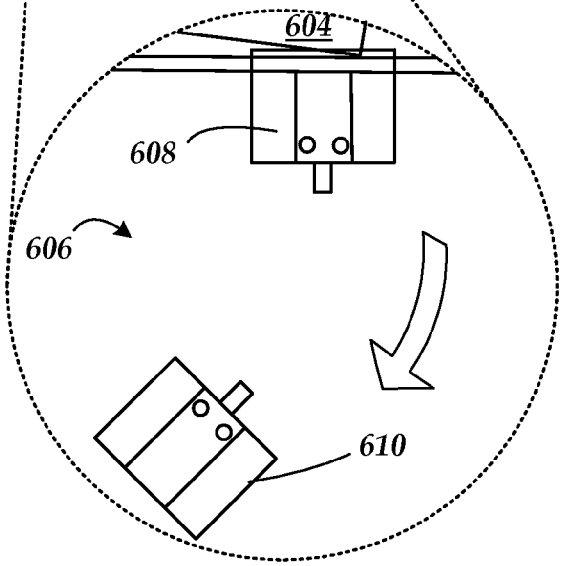
FIG. 6B is an enlarged view of an internal portion of the uninstalled flush-mounted vehicle control barrier system of FIG. 6A showing a configuration of positional sensors according to embodiments presented herein.

According to one embodiment, the wedge plate position detection system 600 includes a proximity sensor system 606 having a flag mechanism 602 configured to provide a controller 612 with proximity data indicating the current position of the wedge plate 104. Specifically, the flag mechanism 602 allows the controller 612 to determine when the wedge plate 104 is approaching the deployed and stowed configurations, and when the wedge plate 104 has reached the deployed and stowed configurations. The controller 612 may then vary a deployment or retraction speed of the wedge plate 104 according to the current position of the wedge plate 104. According to one implementation, the flag mechanism 602 may be an arced member that is fixedly attached to the wedge plate 104. As seen in FIG. 6B, the distal end 604 of the flag mechanism 602 activates a proximity sensor system 606 at and near the upper and lower limits of the wedge plate 104 travel range.

According to this embodiment, the proximity sensor system 606 includes an upper proximity sensor 608 and a lower proximity sensor 610. The upper proximity sensor 608 and the lower proximity sensor 608 are attached to the sub-frame 102 at positions correlating to the distal end 604 of the flag mechanism 602 at the deployed and stowed positions. When the flag mechanism 602 rotates with the wedge plate 104 during deployment, the distal end 604 engages the upper proximity sensor 608, activating the switch and slowing the wedge plate 104. After the distal end 604 disengages the upper proximity sensor 608, the switch is deactivated and the controller 612 stops the wedge plate 104, which configures the vehicle control barrier system 100 in the deployed configuration. When the flag mechanism 602 rotates with the wedge plate 104 during stowage, the distal end 604 engages the lower proximity sensor 610, activating the switch and slowing the wedge plate 104. After the distal end 604 disengages the lower proximity sensor 610, the switch is deactivated and the controller 612 stops the wedge plate 104, which configures the vehicle control barrier system 100 in the stowed configuration. It should be appreciated that the proximity sensor system 606 may include any type of sensors or other devices that are capable of determining the current position of the wedge plate 104.

According to another embodiment, the wedge plate position detection system 600 may include an inclinometer 614. The inclinometer 614 may be mounted at any position on the wedge plate 104, impact-absorption linkages 106, control linkages 110, and/or any other component that experiences a change in tilt or rotation angle with the deployment or retraction of the wedge plate 104. The inclinometer 614 may be communicatively coupled to the controller 612 for communication of the proximity data indicating the current position of the wedge plate 104.

According to yet another embodiment, the wedge plate position detection system 600 may include a servo system 616 coupled to the control components that drive the wedge plate 104 to determine its current position. The servo system 616 may utilize encoder technology to provide feedback regarding the current state of the drive mechanism, which corresponds to the current position of the wedge plate 104. As stated above, the various wedge plate position detection systems 600 disclosed herein are for illustrative purposes only and are not intended to be limiting.

According to one embodiment, the controller 612 may include a programmable logic controller (PLC) or other computer hardware and/or software device. The controller 612 may be communicatively coupled to any number and types of input devices. Upon receiving input from one or more input devices, the controller 612 is operative to activate or reverse the actuator mechanism to deploy or retract the wedge plate 104. For example, the PLC may be programmed to accept input from push buttons, key cards, keypads, loop devices, and any other input from larger control systems. According to one example implementation, the PLC will not activate the actuator mechanism to retract the wedge plate 104 and allow vehicle access until a corresponding vehicle control barrier system 100, gate, or vehicle control device has activated to prevent access. It should be appreciated that the controller 612 shown in FIG. 6A is shown for illustrative purposes only and is not indicative of the location of the controller 612. Rather, it should be appreciated that the controller 612 may be installed at any location with respect to the vehicle control barrier system 100. According to various embodiments, the controller 612 is located externally to the vehicle control barrier system 100 and is communicatively connected to the applicable control components for control of the wedge plate 104.

Figure 7:
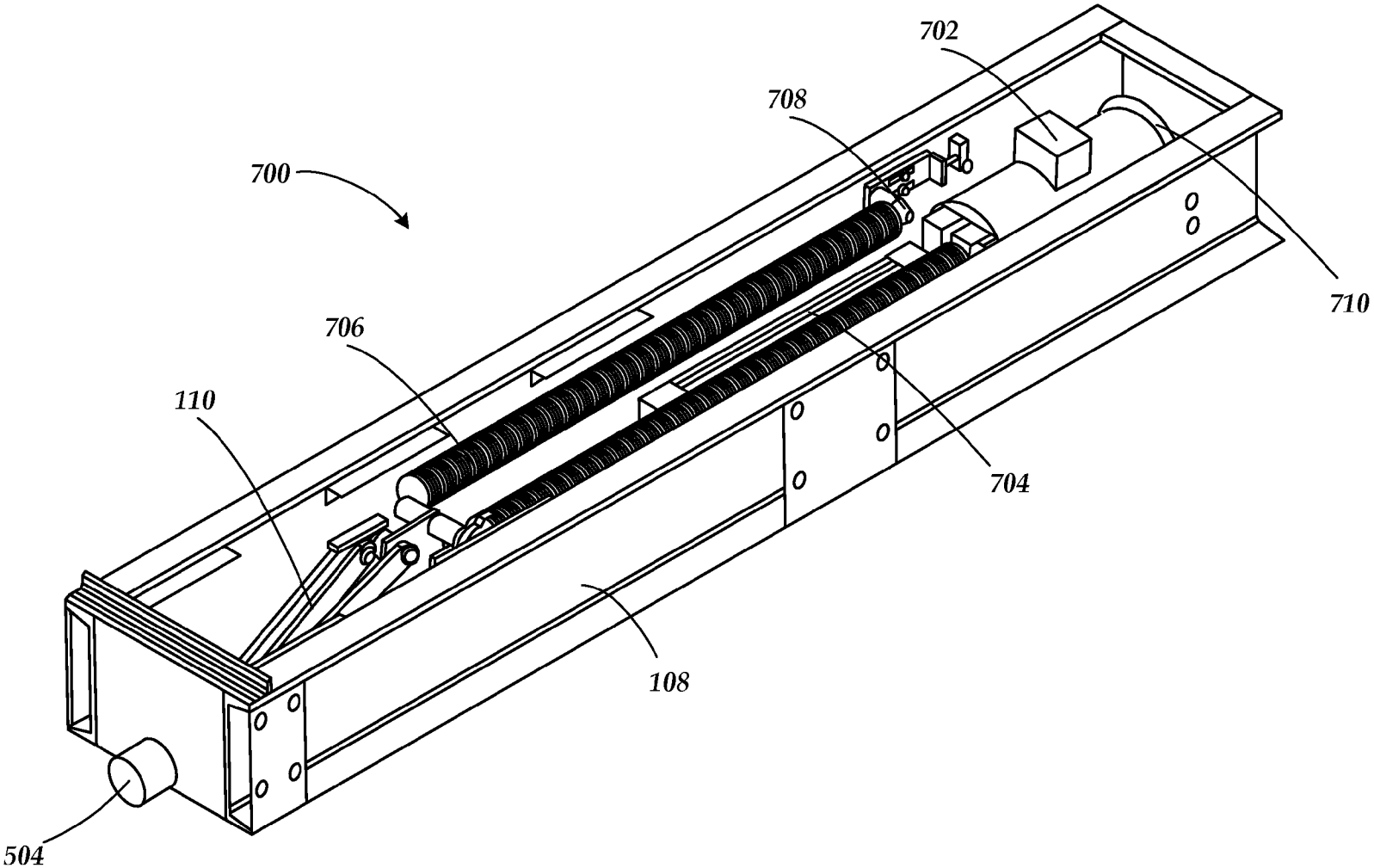
FIG. 7 is a perspective view of a drive box assembly and associated control components according to embodiments presented herein.
Figure 8:
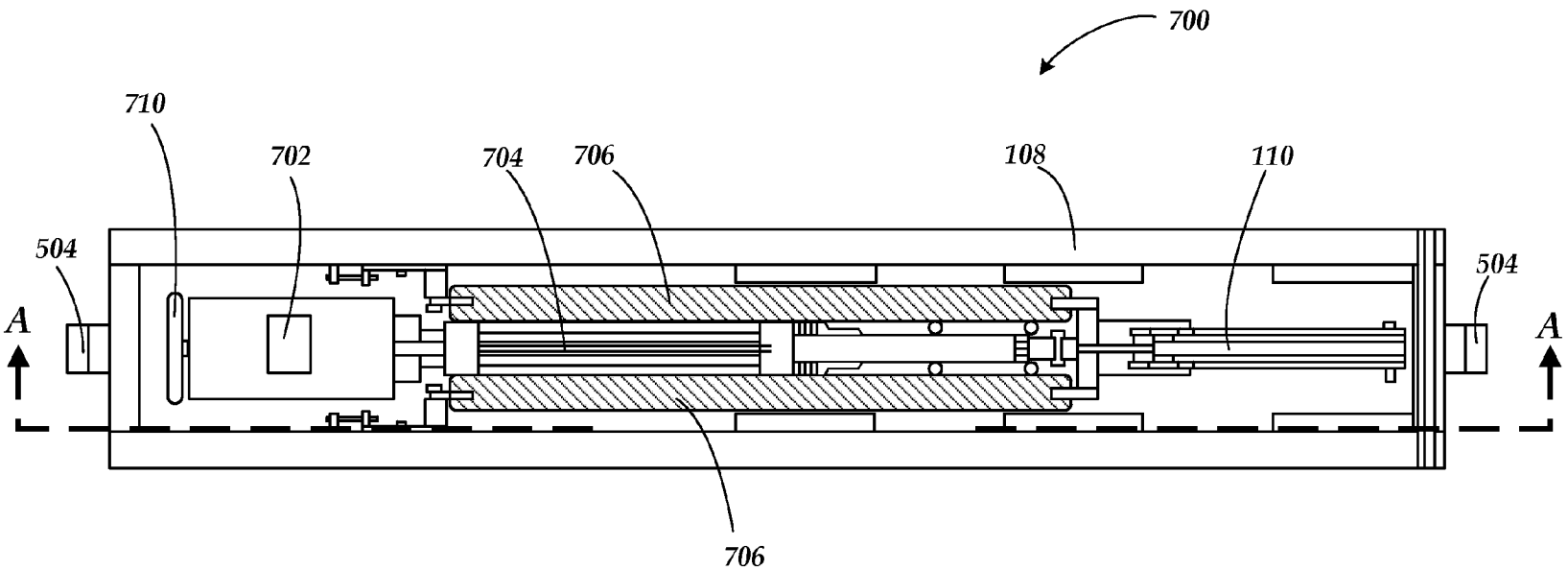
FIG. 8 is a top view of the drive box assembly and associated control components of FIG. 7 according to embodiments presented herein.

FIGS. 7 and 8 show perspective and top views, respectively, of a drive box assembly 108 and associated control components 700 housed within. According to one embodiment, the control components 700 include, but are not limited to, a motor 702, an actuator mechanism 704, and springs 706. As will be described in detail below with respect to FIGS. 9 and 10, to raise and lower the wedge plate 104, the motor 702 activates the actuator mechanism 704, which is coupled to the control linkages 110 used to drive the wedge plate 104 between deployed and stowed configurations. The motor 702 may be any type of motor suitable for driving the actuator mechanism 704. According to one implementation, the motor includes a two horsepower alternating current (AC) electric motor, although any size and type of motor 702 may be used. Utilizing electrical motors and corresponding actuator mechanisms 704 allows for a simpler, smaller, and easier to maintain drive system as compared to hydraulic and other systems.

The actuator mechanism 704 may be a linear actuator such as a ball screw actuator that converts rotational motion into linear motion. One or more springs 706 may be utilized to assist the actuator mechanism 704 in raising the wedge plate 104. According to the embodiments shown in FIGS. 7-10, the vehicle control barrier system 100 utilizes two springs 706 for each actuator mechanism 704. The springs 706 are pre-loaded with tension when the wedge plate 104 is stowed to provide a spring force that assists the actuator mechanism 704, decreasing the actuating force required by the actuator mechanism 704 to pull the control linkages 110 rearward toward the motor 702. By using the springs 706 to assist the actuator mechanism 704, the size of the actuator mechanism 704 and corresponding motor 702 may be decreased, which allows for a shallower foundation depth 124 and decreases the cost of the control components 700 and installation as well as significantly reducing energy costs for operating the barrier. In the case of a loss of electrical power, failure of the actuator mechanism 704, or failure of the motor 702, the control components 700 may include a manual operation for raising and lowering of the wedge plate 104, such as the hand wheel 710.

It should be understood that the configuration of the control components 700 is not limited to the configuration shown and described herein. For example, the control linkages 110 could be configured so that the actuator mechanism 704 applies a pushing force rather than a pulling force in order to deploy the wedge plate 104. In this embodiment, the springs 706 would be installed in compression so that they apply a pushing force to assist the actuator mechanism 704 during deployment of the wedge plate 104. Moreover, alternative embodiments utilize a single spring 706 or no spring. Depending on the size of the wedge plate 104, a single actuator mechanism 704 may be utilized and may be coupled to the wedge plate 104 at either end, or may be coupled to the wedge plate 104 at a central location in approximately the middle of the wedge plate 104.

Figure 9:
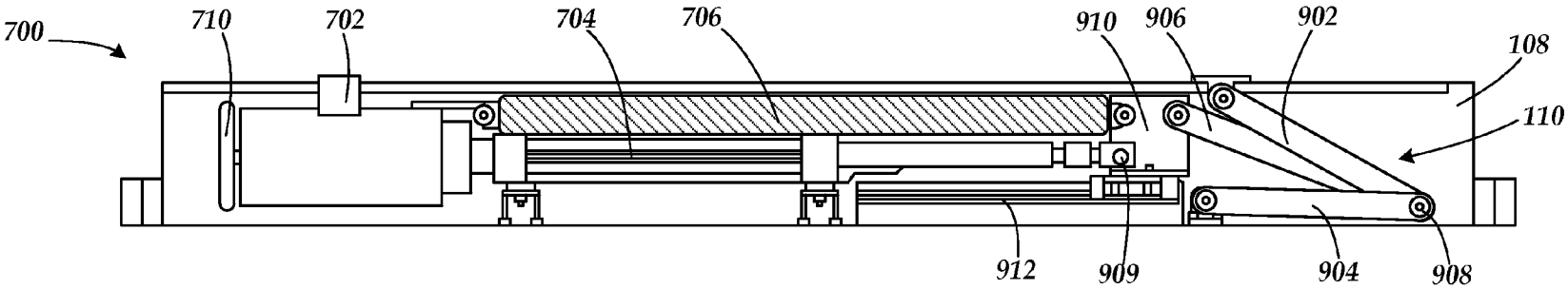
FIG. 9 is a side cross-sectional view of the drive box assembly and associated control components of FIG. 7 in the stowed configuration according to embodiments presented herein.
Figure 10:
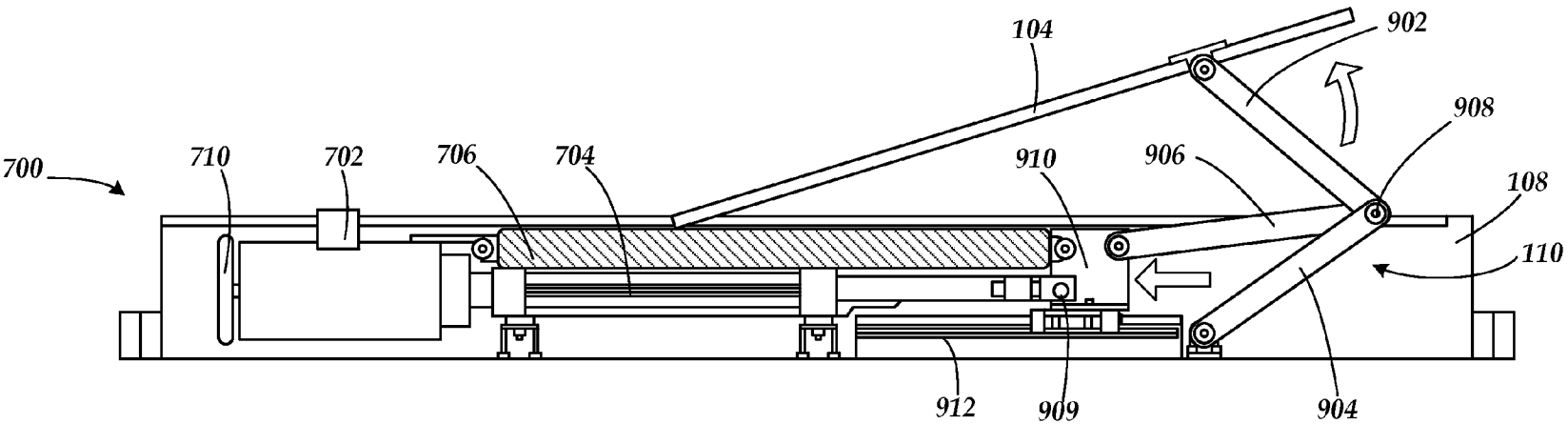
FIG. 10 is a side cross-sectional view of the drive box assembly and associated control components of FIG. 7 in the deployed configuration according to embodiments presented herein.

Referring to FIGS. 9 and 10, operation of the control components 700 to raise and lower the wedge plate 104 will be described with respect to the cross-sectional side views taken along line A-A of the drive box assembly 108 of FIG. 8. FIG. 9 shows one set of control components 700 in the stowed configuration. It can be seen that the actuator mechanism 704 is horizontally mounted within the drive box assembly 108 and extends from the motor 702. As mentioned above, the actuator mechanism 704 may be a ball screw type of linear actuator. A translating connector 909 of the actuator mechanism 704 is coupled to a linear bearing linkage attachment 910. It can be seen that the springs 706 are also coupled at one end to the linear bearing linkage attachment 910.

The linear bearing linkage attachment 910 is coupled to a linear bearing 912 that allows the linear bearing linkage attachment 910 to translate forward and aft along a horizontal axis as the actuator mechanism 704 is selectively operated in one direction and the other. According to one implementation, the linear bearing 912 includes a rail to which the linear bearing linkage attachment 910 is slidably connected via ball bearings. In this manner, the linear bearing linkage attachment 910 is configured to convert the linear motion of the actuator mechanism 704 to the control linkage 110 that is connected to the linear bearing linkage attachment 910 and to the wedge plate 104.

Comparing FIG. 9 in which the wedge plate 104 is positioned in the stowed configuration to FIG. 10 in which the wedge plate 104 is in the process of deploying, it will become clear how the control linkage 110 operates to raise and lower the wedge plate 104. As seen in FIG. 9, the control linkage 110 may include three linkage members, which are all rotatably connected at a central joint 908. An upper control linkage member 902 is attached to the bottom side of the wedge plate 104 at one end, and to the central joint 908 at the opposing end. A lower control linkage member 904 is attached to the central joint 908 at one end and to a fixed attachment point of the drive box assembly 108 at the opposing end. A central control linkage member 906 is coupled to the central joint 908 at one end and to the linear bearing linkage attachment 910 at the opposing end.

The central control linkage member 906 functions to pull and push the central joint 908 rearward and forward in conjunction with the linear bearing linkage attachment 910 as the actuator mechanism 704 is operated. As seen in FIG. 10, as the central joint 908 is pulled rearward, the lower control linkage member 904 rotates upward around the fixed attachment point of the drive box assembly 108. As a result, the upper control linkage member 902 pushes the wedge plate 104 upward into the deployed configuration. This unique configuration of a horizontally installed actuator mechanism 704 within the sub-frame 102 that transfers a linear deploying force upwards to the wedge plate 104 via the control linkage 110 is one advantageous feature that allows for the vehicle control barrier system 100 to be mounted in a shallow foundation 114 that is not possible with conventional vehicle barrier systems.

Figure 11:
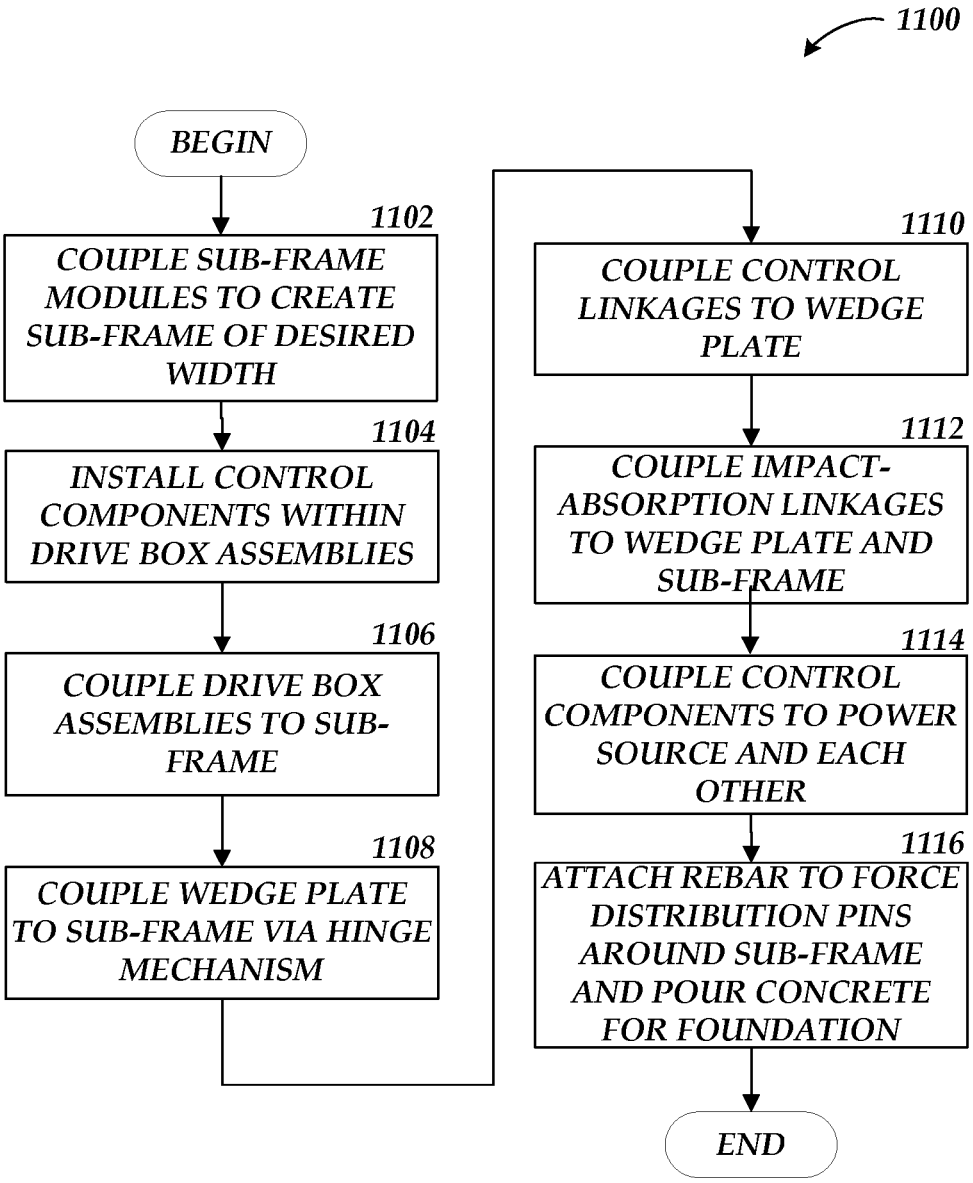
FIG. 11 is a flow diagram illustrating a method for providing a vehicle control barrier according to various embodiments presented herein.

Turning to FIG. 11, an illustrative routine 1100 for providing a vehicle control barrier will now be described in detail. It should be appreciated that more or fewer operations may be performed than shown in the FIG. 11 and described herein. Moreover, these operations may also be performed in a different order than those described herein. The routine 1100 begins at operation 1102, where the applicable sub-frame modules are selected and bolted or otherwise coupled together to create a sub-frame 102 of desired width 116.

At operation 1104, the control components 700 are installed within the drive box assemblies 108. As discussed above, various embodiments utilize a dual-drive system in which two actuator mechanisms 704 and associated control components 700 are used to drive the wedge plate 104 between deployed and stowed configurations, while alternative embodiments utilize a single actuator mechanism 704. For each drive box assembly 108, the actuator mechanism 704, motor 702, springs 706, linear bearing linkage attachment 910, linear bearing 912, and control linkage 110, as well as associated hardware, is installed and coupled as described above. According to one embodiment, one or more controllers 612 are communicatively coupled to the control components 700. The wedge plate position detection system may additionally be installed at operation 1104, either within the drive box assemblies 108 or at any other desired location within the sub-frame 102 and communicatively coupled to the one or more controllers 612.

From operation 1104, the routine 1100 continues to operation 1106, where the drive box assemblies 108 are coupled to the sub-frame 102. As discussed above, the location of the drive box assemblies 108 may be at the outer opposing edges of the sub-frame 102, or may alternatively be between other sub-frame modules at any location within the sub-frame 102. "Coupling" as used in this and other operations may include any suitable methods for securing one component to another, including but not limited to the use of bolts, screws, rivets, welds, adhesive, clamps, or any combination thereof.

At operation 1108, the wedge plate 104 is coupled to the sub-frame 102 via the hinge mechanism 112 at the rear edge of the wedge plate 104. As described above, the hinge mechanism 112 is flush with the top surface of the barrier and does not extend into the interior space below the surface as with conventional vehicle barrier systems. The routine 1100 continues from operation 1108 to operation 1110, where the control linkages 110 are coupled to the bottom side of the wedge plate 104 and to the actuator mechanisms 704 and drive box assemblies 108. Specifically, for each control linkage 110 according to one embodiment, an upper control linkage member 902 is attached to the bottom side of the wedge plate 104 at one end, and to a central joint 908 at the opposing end. A lower control linkage member 904 is attached to the central joint 908 at one end and to a fixed attachment point of the drive box assembly 108 at the opposing end. A central control linkage member 906 is coupled to the central joint 908 at one end and to the linear bearing linkage attachment 910 at the opposing end.

At operation 1112, a number of impact-absorption linkages 106 are attached to the bottom side of the wedge plate 104 and to the sub-frame 102. The routine 1100 continues to operation 1114, where the applicable control components 700 are electrically connected to a power source and communicatively connected to one another. For example, the motor 702 is electrically connected to a power source and mechanically coupled to the actuator mechanism 704. The controller 612 is electrically connected to a power source and communicatively connected to the proximity sensor system 606 and the motor 702 and actuator mechanism 704. The controller 612 may additionally be coupled to any number and type of input devices for activating and deactivating the actuator mechanism 704 as described above, such as push buttons, key cards, keypads, loop devices, and any other input from larger control systems.

At operation 1116, the rebar and/or other structural support members are attached to the force distribution pins 506 and concrete is poured to create the foundation 114. The routine 1100 ends. The foundation 114 may include any dimensions suitable for satisfactorily receiving and dissipating a vehicle crash force. It should be clear from the disclosure above that the technologies described herein allow for a foundation 114 and sub-frame 102 depth 124 that is more shallow than those of conventional vehicle barrier systems.

The subject matter described above is provided by way of illustration only and should not be construed as limiting. Various modifications and changes may be made to the subject matter described herein without following the example embodiments and applications illustrated and described, and without departing from the true spirit and scope of the present disclosure, which is set forth in the following claims.

What is claimed is:

1. A flush-mounted vehicle control barrier, comprising:

a sub-frame defining a bottom barrier surface, a top barrier surface, and an interior space between the bottom barrier surface and the top barrier surface;

a wedge plate coupled to the sub-frame and coplanar with the top barrier surface when configured in a stowed position; and an actuator mechanism coupled to the wedge plate via a control linkage such that linear retraction of the actuator mechanism pulls on a linkage member of the control linkage to deploy the wedge plate, the actuator mechanism disposed within the interior space when the wedge plate is configured in the stowed position and operative to rotate the wedge plate between the stowed position and a deployed position.

2. The flush-mounted vehicle control barrier of claim 1, further comprising a plurality of impact-absorption linkages coupled to a bottom side of the wedge plate and to the sub-frame.

3. The flush-mounted vehicle control barrier of claim 2, wherein each of the plurality of impact-absorption linkages comprises a two-piece articulated device that is centrally jointed and configured to fold inward during stowage of the wedge plate.

4. The flush-mounted vehicle control barrier of claim 1, wherein the wedge plate is coupled to the sub-frame via the hinge mechanism that is coplanar with the top barrier surface and positioned above the interior space.

5. The flush-mounted vehicle control barrier of claim 4, wherein the hinge mechanism comprises a locking mechanism configured to prevent rearward lateral movement of the wedge plate when positioned in the deployed position.

6. The flush-mounted vehicle control barrier of claim 1, further comprising a drive box assembly sized for housing the actuator mechanism within the interior space of the sub-frame.

7. The flush-mounted vehicle control barrier of claim 1, further comprising an electric motor operative to drive the actuator mechanism.

8. The flush-mounted vehicle control barrier of claim 7, further comprising at least one spring coupled to the actuator mechanism and pre-loaded with tension such that the at least one spring provides a spring force to the actuator mechanism in a direction of a deploying force generated by the actuator mechanism when deploying the wedge plate.

9. The flush-mounted vehicle control barrier of claim 8, wherein the at least one spring comprises two parallel springs mounted adjacent to one another.

10. The flush-mounted vehicle control barrier of claim 1, wherein the sub-frame comprises a plurality of modular sections coupled together according to a desired barrier width.

11. The flush-mounted vehicle control barrier of claim 1, further comprising a controller communicatively coupled to the actuator mechanism and operative to selectively activate the actuator mechanism in forward and reverse directions, rotating the wedge plate between the stowed position and a deployed position.

12. The flush-mounted vehicle control barrier of claim 1, wherein the control linkage comprises three linkage members, the three linkage members comprising an upper control linkage member coupled to a bottom side of the wedge plate, a lower control linkage member coupled to a fixed attachment point of the sub-frame, and a central control linkage member coupled to the actuator mechanism such that activation of the actuator mechanism to deploy the wedge plate pulls the central control linkage member, rotating the lower control linkage member around the fixed attachment point, and lifting the upper control linkage member to apply the upward deploying force to the wedge plate.

13. A method for providing a vehicle control barrier, the method comprising:

pivotally connecting a rear edge of a wedge plate to a sub-frame;

mounting an actuator mechanism within an interior space of the sub-frame between a top barrier surface of the sub-frame and a bottom barrier surface of the sub-frame; and coupling the actuator mechanism to a bottom side of the wedge plate via a control linkage such that when the actuator mechanism is activated, the actuator mechanism linearly retracts, pulling on a linkage member of the control linkage and rotating the wedge plate upwards from the sub-frame, and when the actuator mechanism is reversed, the actuator mechanism linearly extends, allowing the wedge plate to rotate to a stowed position that is coplanar with the top barrier surface of the sub-frame.

14. The method of claim 13, further comprising attaching rebar to the sub-frame around a perimeter of the sub-frame and pouring concrete around the sub-frame and encompassing the rebar to create a foundation.

15. A vehicle control barrier system, comprising:

a sub-frame defining a bottom barrier surface, a top barrier surface, and an interior space between the bottom barrier surface and the top barrier surface, the sub-frame comprising a plurality of modular sections coupled together according to a desired barrier length;

a wedge plate coupled to the sub-frame and coplanar with the top barrier surface when configured in a stowed position, the wedge plate sized according to the desired barrier width;

an actuator mechanism coupled to a bottom side of the wedge plate via a control linkage such that linear retraction of the actuator mechanism pulls on a linkage member of the control linage to deploy the wedge plate, the actuator mechanism disposed within the interior space when the wedge plate is configured in the stowed position; and a controller communicatively coupled to the actuator mechanism and operative to selectively activate the actuator mechanism in forward and reverse directions, rotating the wedge plate between the stowed position and a deployed position.

16. The vehicle control barrier system of claim 15, further comprising a wedge plate position detection system operative to determine a current position of the wedge plate, wherein the controller is further operative to vary a deployment or retraction speed of the wedge plate according to the current position.

17. The vehicle control barrier system of claim 15, wherein the sub-frame further comprises a plurality of force distribution pins protruding from one or more exterior vertical surfaces of the sub-frame, and wherein the vehicle control barrier system further comprises a foundation encompassing a perimeter of the sub-frame, the foundation comprising rebar in contact with the plurality of force distribution pins and encased within concrete.

* * * * *